United States Patent [19]

Trebnick

[11] 4,157,597

[45] Jun. 12, 1979

[54] OPERATOR PROPELLED WATER SKIS

[76] Inventor: Ralph J. Trebnick, 316 N. 7th Ave., Bovey, Minn. 55709

[21] Appl. No.: 876,996

[22] Filed: Feb. 13, 1978

[51] Int. Cl.[2] ..... A63C 15/04

[52] U.S. Cl. ..... 9/310 D; 9/310 C; 115/26

[58] Field of Search ..... 9/310 R, 310 C, 310 D, 9/311, 349; 115/21, 22, 25, 26, 28 R

[56] References Cited

U.S. PATENT DOCUMENTS

| | | | |
|---|---|---|---|
| 3,084,356 | 4/1963 | Wheat | 9/310 D |
| 3,115,860 | 12/1963 | Payne | 9/310 C X |
| 3,621,500 | 11/1971 | Senghas | 9/310 D |
| 4,034,430 | 7/1977 | Joyce | 9/310 D |

*Primary Examiner*—Trygve M. Blix

*Assistant Examiner*—Winston H. Douglas

*Attorney, Agent, or Firm*—Schroeder, Siegfried, Ryan, Vidas & Steffey

[57] ABSTRACT

This invention relates to operator propelled water skis comprising a pair of elongated float-type ski members with suitable operator foot supports therein mounted in a thwart-type frame having outrigger floats attached thereto. A pair of ski pole floats are similarly positioned on the frame and are slidable relative thereto through movement of ski poles coupled to the floats to increase stability of the water skis to the operator and provide a means for propelling the skis. The ski members and ski pole floats have surfaces thereon which increase the resistance of movement of the floats and ski members in one direction of the skis and reduce resistance in the opposite direction of movement to aid in movement of the skis.

11 Claims, 5 Drawing Figures

OPERATOR PROPELLED WATER SKIS

FIELD OF INVENTION

This invention relates to an apparatus for walking on water and more particularly to an improved operator propelled water skis.

Apparatus for walking on water is known and in use. There are numerous variations of such apparatus in which such structures support a person on water in a standing position and the float structures are propelled through the water by leg movement of the operator. In such apparatus, the float structures are normally interconnected to permit relative movement therebetween. The float structures have means for increasing the resistance to movement of the float in one direction of operator leg movement and decreasing the resistance to movement of the float in the opposite direction of operator leg movement to aid in the overall movement of the float structures. The patents to Sheldon, U.S. Pat. No. 1,692,055; Schaupp, U.S. Pat. No. 2,155,939, and Joyce, U.S. Pat. No. 4,034,430 are examples of the same. Such prior structures are generally complex and expensive in design. Further, they are relatively unstable and difficult to use.

SUMMARY OF THE INVENTION

The present invention is directed to operator propelled water skis. The improved water skis are comprised of a pair of float-type ski members mounted in a channel section of a supporting frame with one of the ski members being secured to the frame and the other being loosely positioned for movement relative to the frame. A pair of ski pole floats are also positioned in the channel section of the frame outboard of the ski members. The ski pole floats have poles associated therewith by which an operator may stabilize his or her position on the skis and manipulate the floats, which slide relative to the frame, to aid in propelling of the skis. The floats and ski members have surfaces thereon which create resistance against the water in a backward direction of movement and aid in the forward direction of movement of the skis. The frame also includes outrigger arms with floats thereon which stablize the frame in the water. The fixed ski member may also include a stablizing center board or vane. The operator propelled water skis are preferably made of a plastic material with the ski members and floats having buoyant cores therein. The apparatus is stable and relatively light in weight so as to be easy to operate and effective in the propelling of the person on water.

DESCRIPTION OF THE PREFERRED EMBODIMENT

Figure 5:
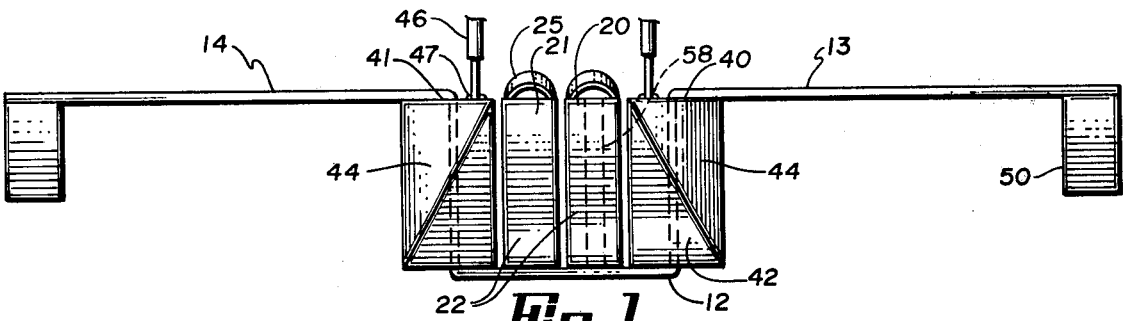
Figure 1:
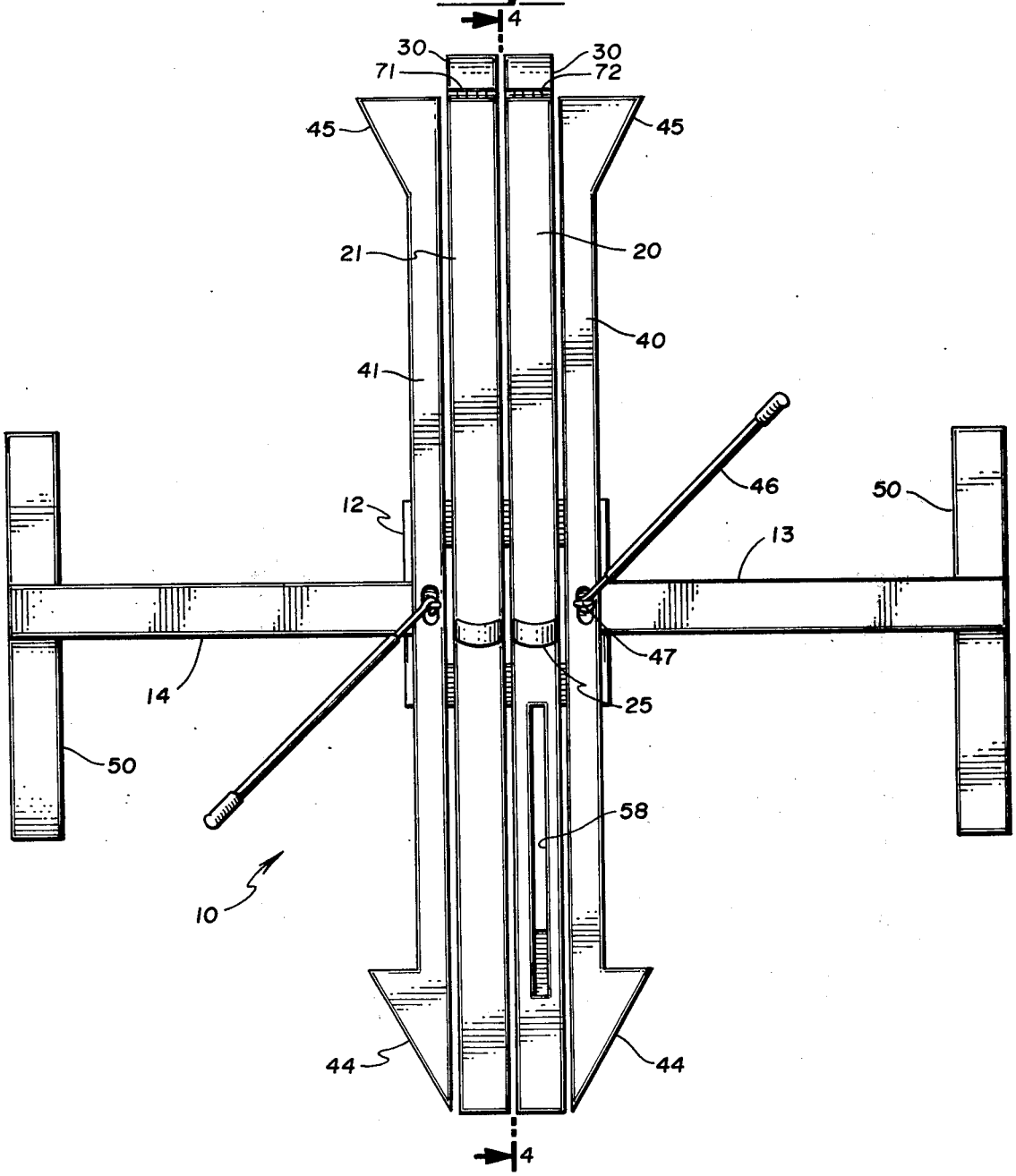
FIG. 1 is a plan view of the improved operator propelled water skis.
Figure 3:
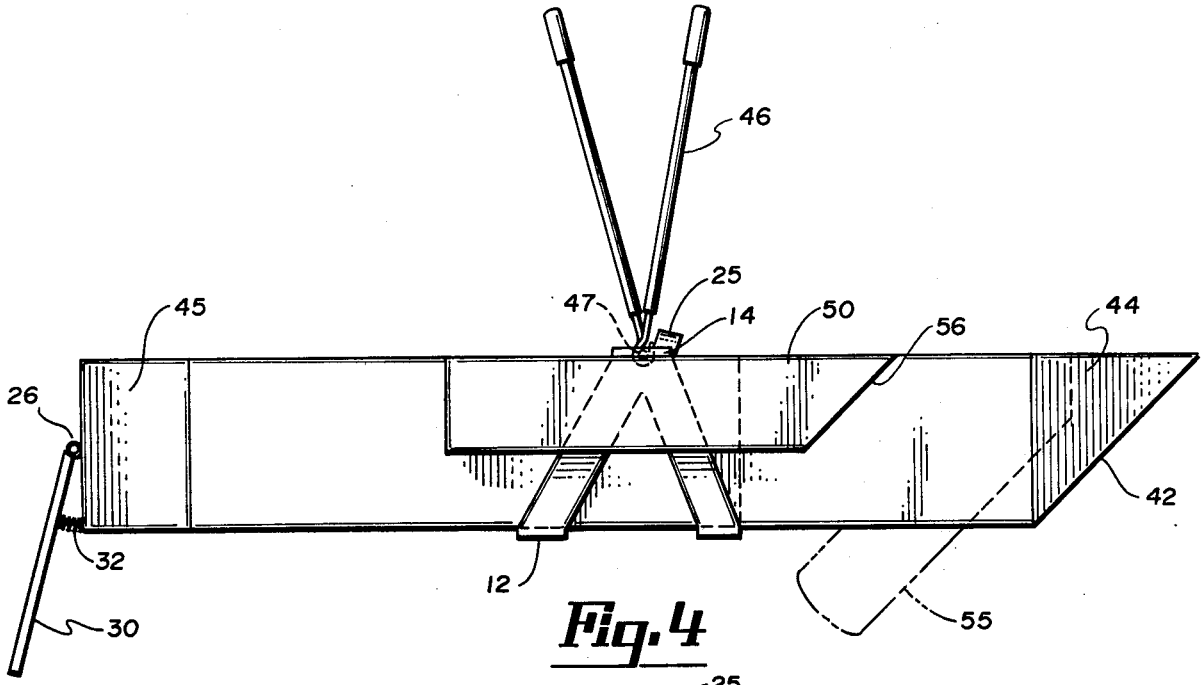
FIG. 3 is a side elevation view of the water skis of FIG. 1.
Figure 4:
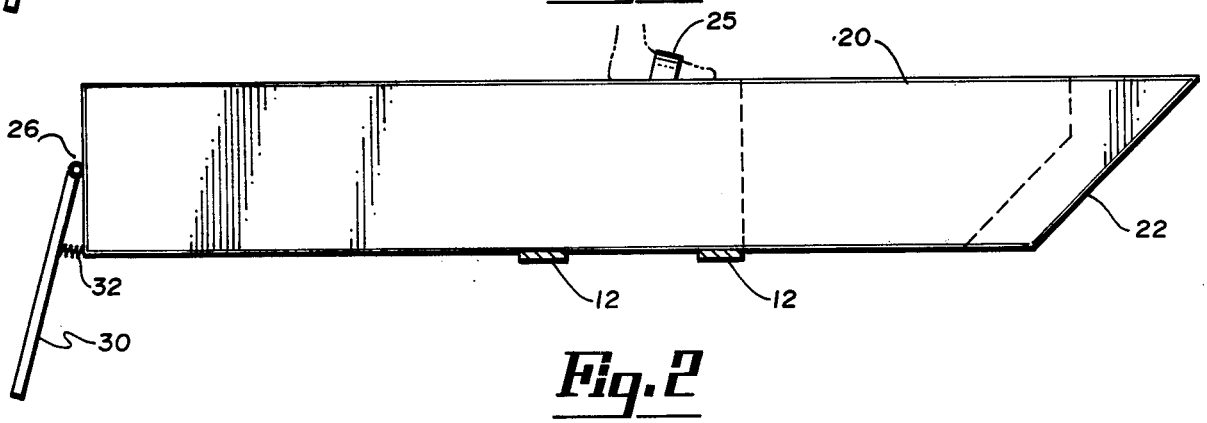
FIG. 4 is a sectional view taken along the lines 4—4 of FIG. 1; and, FIG. 5 is a front elevation view of the water skis.
Figure 2:
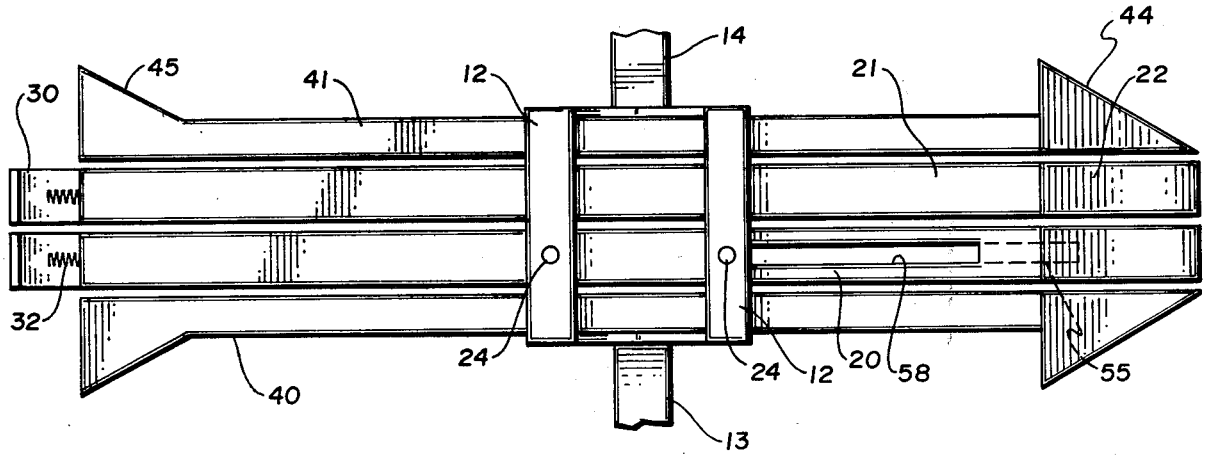
FIG. 2 is a bottom view of the water skis of FIG. 1.

My improved operator propelled water skis are shown in plan and bottom views in FIGS. 1 and 2. These water skis include a thwart type frame 10 which has a generally U-shaped channel section 12 at the center of the same and a pair of outwardly extending arms 13 and 14 forming outrigger arms. The thwart type frame may be made of varying types of materials, such as molded plastic or metal, such as aluminum or steel. The frame is preferably made of a relatively thin strips of material which are suitably secured together. The channel section 12 is preferably formed of two spaced strips which are bent in a rectangular base configuration with inclined sides which are joined together at the top of the frame to connect to the outrigger arms. The thwart frame mounts a pair of ski members 20 and 21 which are elongated floats having a generally rectangular cross section and a forward end tapered upwardly, as at 22.

The ski members may be made of varying materials and are preferably formed with a core of foamed plastic material having sufficient strength and rigidity to form a buoyant core with a covering of suitable plastic material of either thermoplastic or thermosetting plastic. The covering may include fiber gloss for strength.

Positioned on the top of each float member is a foot support 25 which may take the form of a rubber, metal or plastic strap secured to the top surface of the float midway along its extent which is to receive the foot or shoe of an operator.

The ski members are positioned in the channel section with one of the ski members 20 being secured to the straps forming the channel section, as indicated at 24 in FIG. 2, and with the other member 21 being movable relative thereto, for purposes to be later noted. The aft section of each ski member mounts a pivoted paddle member 30 which paddle member is a flat plate-like structure, similarly made of plastic or other material, and pivotally connected through a hinge 26 to the end of the ski member. A spring 32 is positioned between the paddle member and the end of the ski member to bias the paddle member to a generally aligned positioned with the extent of the ski member. The pivoted paddle members are moved to compress the spring whenever water pressure is brought to bear against the face of the same, such as by moving the ski members in a reverse direction, that is, paddle end first through the water. The pivoted paddle members as well as the inclined front faces 22 of the ski member, allow the ski members or elongated float structures to move through the water with a relatively minimum of resistance in the direction of the inclined surface 22. The paddle members generally align to the extent of ski members so as to offer a minimum of resistance to the movement of the ski members through the water. Any movement of the ski member in the opposite direction will cause the paddle member to pivot against the end of the ski member presenting a larger area of resistance of movement through the water and providing a surface by means of which a ski may be pushed through the water.

The water skis also include ski pole floats 40, 41 which are positioned in the channel section 12 of the frame and are movable relative thereto. The ski pole floats are similarly elongated float members which are preferably made of a core of buoyant material having a thermoplastic material covering the same. The floats 40, 41 are basically the same length as the ski members 20, 21 and are positioned to either side of the same in the channel section 12 of the frame. They similarly are of the same height and have a width dimension such that the ski members and floats extend a distance slightly less the width of the channel section so that the floats and one of the ski members may be slidably movable in the channel section. Similarly, the ski pole floats have a similarly inclined front surface 42 at an approximate angle of about 45° similar to the ski members to minimize resistance of movement through the water in the forward direction. The ski pole floats have inclined surfaces on the outboard sides of the same as they are positioned in the frame. Thus, the front or forward end has an inclined surface 44 starting from the forward tip of the float and extending at an angle of approximately 45° with a rearward side extending at an angle to the inclined side of about 45° to make a relatively flat surface normal the extent of the float. The aft or rear end of each float has a similarly inclined surface 45 at a reduced angle which extends to the end of the float such as to increase the width of the rear surface of the float to approximately the same width as that created by the forward inclined surface 44. These inclined surfaces aid in movement of the ski pole floats in the forward direction through the water and provide broadened surfaces for resisting flow through the water in the rearward direction of motion of float through the water to aid in propelling of the skis through the water. Similarly, the increased width of the front and rear ends of the ski pole floats insure that the ski pole floats will not slide out of the channel section.

Each of the floats 40 and 41 are constructed in the same manner and the top surfaces of the floats have coupling means 47 thereon by which poles 46 may be pivotally connected thereon. The coupling means 47 may be recessed surfaces with a retainer such as a hook to fit through an aperture in the end of the ski pole to retain the poles on the skis and pivot the same on the floats. The ski poles 46 will normally be of such a length that they may be readily gripped by an operator in a standing position to manipulate the floats and add stability to the operator in leg movement of the skis. The poles may be disconnected from the floats when the skis are not in use.

The arms 13 and 14 of the frame similarly mount outrigger floats 50 at the ends of the same which floats are secured to the arms in a position generally parallel to the extent of the ski pole floats and the ski members in the channel section. The outrigger floats similarly have tapered forward extremities, as indicated at 56, and have a much shorter length and depth dimension. The outrigger floats are similarly constructed on the relatively rigid core of buoyant material, preferably a foam plastic, with a skin or covering of the thermoplastic material over the same.

The fixed ski member 20 may include a recesses therethrough, as indicated in 58, by means of which a drop center board or vane 55 may be added to the ski member to aid in steering of the same. The vane or center board 55 may, if desired, be rigidly secured to the ski member to provide a fixed vane from the bottom surface thereof, or it may be removable.

In use, the improved operator propelled water skis provide a relatively lightweight structure for aid in moving the person on water. The floats formed by the ski members and ski pole floats together with the outrigger floats provide sufficient buoyancy to readily support a person on water. The operator will position his feet or shoes through the straps or foot support 25 in each ski and grip the ski poles 46 coupled to the ski pole floats 40, 41 for the purpose of operating the water skis. Through suitable leg movement and arm movement, the operator will be able to move the movable and fixed ski member 21, respectively, moving the frame with the outrigger floats attached thereto and through additional movement of the ski pole floats to propel the water skis through water. The ski pole floats in addition to providing support and stability to the operator through his arms, permit the arm movement to generate a propelling force through the tapid surfaces of the ski pole floats which slid in the channel section of the frame. Similarly, the movable ski and the fixed ski together with the pivoted paddles at the rear of the same provide a surface for increasing the thrust against water as the skis are propelled. If desired, the outrigger arms 13, and 14 may be made telescopic or in sections to increase or decrease the length of the same. Decreasing the length of the arms may slightly vary the stability of the overall apparatus, but increase the movability of the same.

In considering this invention it should be remembered that the disclosure of the invention is illustrative only and the scope of the invention should be determined by the appended claims.

What I claim is:

1. Operator propelled water skis comprising: a pair of elongated float type ski members with operator foot supports included thereon for propelling said ski members, a thwart type frame for mounting said ski members, said frame having a channeled shaped support section at the center thereof and outwardly extending stabilizer means, a pair of ski pole floats, means included on the ski pole floats being adapted to couple pole means to enable an operator to move the ski pole floats, said ski pole floats and said ski members being positioned in said channel shaped support section of said frame in a side-by-side relationship with one of said ski members being secured to said frame and the other of said ski members and said ski pole floats being movable relative thereto, and means included on at least the ski members adapted to increase resistance to movement of the ski members in one direction of the movement of the ski members when the skis are positioned in water and to reduce resistance to movement of the ski members in the opposite direction of the movement of the ski members.

2. The operator propelled water skis of claim 1 in which the outwardly extending stabilizer means are outrigger arms extending from the channel shaped support section of the frame with outrigger floats secured at the ends of the same.

3. The operator propelled water skis of claim 2 in which the means included at least on the ski members are pivoted paddle members mounted on the ski members and movable between an aligned position to a transverse position with respect to the extent of the ski members.

4. The operator propelled water skis of claim 3 in which the pivoted paddle members are located at one end of each of the ski members and spring means bias the paddle members to an aligned position with respect to the extent of the ski members.

5. The operator propelled water skis of claim 4 in which the ski members are positioned in the channel shaped ski support section of a frame in a side-by-side relationship with a ski pole float positioned outboard of each of the ski members and on either side thereof.

6. The operator propelled water skis of claim 5 in which the ski members and the ski pole floats are substantially the same length and each have tapered extremities to decrease the resistance to movement in the opposite direction of the movement of the ski members and ski pole floats.

7. The operator propelled water skis of claim 1 in which the ski members and ski pole float members are made of a plastic material with bouyant cores.

8. The operator propelled water skis of claim 1 in which the means to increase resistance to movement in one direction of the movement and to reduce resistance to movement in the opposite direction of the movement is included on the ski pole floats.

9. The operator propelled water skis of claim 8 in which the means to increase resistance to movement in one direction of the movement and to reduce resistance to movement in the opposite direction of the movement for the ski pole floats are tapered side flange sections outboard of the ski members one of which is common to the tapered extremity of the ski pole float and one of which is common to the opposite extremity of the ski pole float.

10. The operator propelled water skis of claim 9 in which the operator foot support included on the ski members are straps positioned on the top surface of the ski member.

11. The operator propelled water skis of claim 10 in which the ski member secured to the channel shaped ski support has a transversely extending center board secured thereto and directed from the surface opposite the shoe strap.

* * * * *

UNITED STATES PATENT AND TRADEMARK OFFICE

CERTIFICATE OF CORRECTION

PATENT NO. : 4,157,597

DATED : June 12, 1979

INVENTOR(S) : Ralph J. Trebnick

It is certified that error appears in the above-identified patent and that said Letters Patent are hereby corrected as shown below:

Column 3, line 68, after "21," insert -- 20 --.

Signed and Sealed this

*Twenty-eighth* Day of *August 1979*

[SEAL]

*Attest:*

*Attesting Officer*

LUTRELLE F. PARKER

*Acting Commissioner of Patents and Trademarks*